US012617059B2

(12) United States Patent
Ning et al.

(10) Patent No.: US 12,617,059 B2
(45) Date of Patent: May 5, 2026

(54) SPRAY HEAD DEVICE AND SANDBLASTING DEVICE FOR AUTOMOBILE PART PROCESSING

(71) Applicant: Zhejiang Wanli University, Ningbo (CN)

(72) Inventors: Jingwei Ning, Ningbo (CN); Wen Liu, Ningbo (CN); Hongwei Cui, Ningbo (CN); Kai Lin, Ningbo (CN); Xiang Yan, Ningbo (CN); Hang Wang, Ningbo (CN); Zhiwen Guo, Ningbo (CN); Chi Zhang, Ningbo (CN); Pengfei Liu, Ningbo (CN)

(73) Assignee: Zhejiang Wanli University, Ningbo (CN)

( * ) Notice: Subject to any disclaimer, the term of this patent is extended or adjusted under 35 U.S.C. 154(b) by 618 days.

(21) Appl. No.: 17/970,352

(22) Filed: Oct. 20, 2022

(65) Prior Publication Data

US 2024/0009805 A1 Jan. 11, 2024

(30) Foreign Application Priority Data

Jul. 7, 2022 (CN) ..... 202210802228.7

(51) Int. Cl.
*B24C 5/04* (2006.01)
*B24C 3/06* (2006.01)
*B24C 7/00* (2006.01)

(52) U.S. Cl.
CPC ..... *B24C 5/04* (2013.01); *B24C 7/0046* (2013.01); *B24C 3/06* (2013.01)

(58) Field of Classification Search
CPC B24C 5/02; B24C 5/04; B24C 7/0007; B24C 7/0046; B24C 7/0084; B24C 3/02; B24C 3/04; B24C 3/18; B24C 3/20; B24C 3/22; B24C 3/32
See application file for complete search history.

(56) References Cited

U.S. PATENT DOCUMENTS 2,059,294 A * 11/1936 Thorndike ..... B24C 5/04 451/102
2,508,766 A * 5/1950 Morel ..... B24C 5/04 239/428
2,628,456 A * 2/1953 Berg ..... B24C 3/065 451/87
2,801,133 A * 7/1957 Ridley ..... B05B 7/149 239/602
4,648,215 A * 3/1987 Hashish ..... B24C 5/04 451/40

(Continued)

*Primary Examiner* — Joel D Crandall

(57) ABSTRACT

The present disclosure relates to the technical field of automobile part processing, and specifically provides a spray head device and a sandblasting device for automobile part processing. The spray head device comprises a spray head body and a connecting pipe. A conical through hole is penetratingly arranged in the spray head body, one end of the conical through hole forms a discharge port, the other end of the conical through hole forms a feed port, the caliber of the feed port is greater than that of the discharge port, the connecting pipe is fixedly connected to one end of the feed port of the spray head body, and the connecting pipe is coaxially arranged with the conical through hole; the conical through hole is penetratingly provided in the spray head body.

8 Claims, 5 Drawing Sheets

(56) References Cited

U.S. PATENT DOCUMENTS

| | | | | | |
|---|---|---|---|---|---|
| 4,709,515 | A * | 12/1987 | Copeland | B24C 7/0076 | 451/99 |
| 4,765,540 | A * | 8/1988 | Yie | B24C 5/04 | 239/467 |
| 4,802,312 | A * | 2/1989 | Glaeser | B24C 7/0046 | 451/75 |
| 5,035,090 | A * | 7/1991 | Szucs | B05B 7/10 | 239/433 |
| 5,123,206 | A * | 6/1992 | Woodson | B24C 7/0084 | 451/39 |
| 5,155,946 | A * | 10/1992 | Domann | B24C 1/045 | 239/428 |
| 5,201,150 | A * | 4/1993 | Kuboyama | B24C 7/0038 | 451/100 |
| 5,462,605 | A * | 10/1995 | Szucs | B24C 7/0076 | 134/198 |
| 6,425,805 | B1 * | 7/2002 | Massa | B24C 5/04 | 29/447 |
| 6,695,686 | B1 * | 2/2004 | Frohlich | B24C 5/04 | 239/433 |
| 8,210,908 | B2 * | 7/2012 | Hashish | B24C 7/0061 | 451/38 |
| 10,974,259 | B2 * | 4/2021 | Rong | B05B 1/18 | |
| 2019/0366508 | A1 * | 12/2019 | Mestanek | B24C 1/045 | |

* cited by examiner

SPRAY HEAD DEVICE AND SANDBLASTING DEVICE FOR AUTOMOBILE PART PROCESSING

CROSS-REFERENCE TO RELATED APPLICATION

This application claims priority from the Chinese patent application 202210802228.7 filed Jul. 7, 2022, the content of which is incorporated herein in the entirety by reference.

TECHNICAL FIELD

The present disclosure relates to the technical field of automobile part processing, and more particularly to a spray head device and a sandblasting device for automobile part processing.

BACKGROUND ART

The existing automobile parts need to be treated with sandblasting and coating after processing. The surface of a workpiece is cleaned and roughened by the impact of high-speed sand flow. The compressed air is used as power to form a high-speed injection beam to inject the spraying material at high speed onto the surface of the workpiece to be treated. Due to the impact and cutting action of the spraying material on the surface of the workpiece, the surface of the workpiece gets a certain degree of cleanliness and different roughnesses so that the mechanical properties of the surface of the workpiece are improved, thereby improving the fatigue resistance of the workpiece, increasing the adhesion, and facilitating the leveling and decoration of the coating in the next step.

At present, a sandblasting operation for an automobile part is generally performed by fixing the automobile part by a jig in a sandblasting chamber, and then performing the sandblasting operation on the automobile part by using a sandblasting device. In the process of sandblasting automobile parts, the high-speed injection beam injects the spraying material onto the surface of the workpiece to be treated at high speed. However, the spraying material is scattered when the spraying material is sprayed out of the spray head, which results in an unsatisfactory sandblasting effect and can not fully meet the users' requirements.

SUMMARY

The present disclosure aims to solve at least one aspect of the above-mentioned technical problems.

In order to solve the above-mentioned problems, the present disclosure proposes the following technical solution:

a spray head device, comprising a spray head body and a connecting pipe, wherein a conical through hole is penetratingly arranged in the spray head body, one end of the conical through hole forms a discharge port, and the other end of the conical through hole forms a feed port; a caliber of the feed port is greater than that of the discharge port, the connecting pipe is fixedly connected to the feed port of the spray head body, the connecting pipe is arranged coaxially with the conical through hole, and the caliber of the connecting pipe is adapted to that of the feeding port;

multiple spiral trunkings are arranged at intervals on an inner wall of the conical through hole, the spiral trunkings extend from one end of the feeding port to one end of the discharging port, and two ends of the spiral trunkings are arranged to be through the spray head body;

the side wall of the connecting pipe is provided with a plurality of injection pipes at regular intervals in its circumferential direction, the injection pipes communicating with the connecting pipe.

Compared with the prior art, an automatic sandblasting device for automobile parts provided by the present disclosure has but is not limited to the following beneficial effects.

A conical through hole is penetratingly provided in the spray head body, and the spraying material enters the conical through hole from the feeding port via the connecting pipe, and is then ejected from the discharging port; since the caliber of the conical through hole becomes gradually smaller, the spraying material will accelerate, and the dispersion of the ejected spraying material can be reduced; the arrangement of the spiral trunking enables the ejected spraying material to rotate around the spiral trunking, so as to increase the ejecting speed of the spraying material, improve the impact force, and enhance the exploitative effect; two ends of the spiral trunking are arranged to be through the spray head body, so as to facilitate spraying material being ejected out to the automobile parts through the spiral trunking; multiple injection pipes are evenly spaced on the side wall of the connecting pipe, and this structure enables the airflow to flow into the conical through hole to be evenly distributed, thereby facilitating the spraying material ejected by the airflow more uniform, so as to improve the spraying effect.

Preferably, the spiral trunking extends in the form of a conical helix.

Preferably, the side wall of the connecting pipe is provided with a plurality of mounting blocks at uniform intervals along its circumferential direction, a communication hole is provided through the mounting block, one end of the communication hole penetrates through the side wall of the connecting pipe to communicate with the connecting pipe, and the mounting block communicates with the injection pipe via the communication hole;

one end of the injection pipe away from the connecting pipe is used for being connected to the air compressor apparatus.

The present disclosure also provides a sandblasting device for automobile part processing, comprising the spray head device as described above.

Preferably, the sandblasting device for automobile part processing further comprises a sand cylinder and a feeding pipeline. One end of the feeding pipeline is connected to the sand cylinder, the other end of the feeding pipeline is connected to the connecting pipe of the spray head device, and the inner wall of the feeding pipeline is provided with microtextures at intervals.

Preferably, the feeding pipeline includes a main pipe, a branch pipe, and a branch joint. One end of the main pipe is communicated with a plurality of the branch pipes through the branch joint, and the spray head device is arranged at the tail end of the branch pipe;

the microtexture is arranged on the inner wall of the branch joint.

Preferably, the sandblasting device for automobile part processing further comprises an air compressor apparatus and a breather pipe, the air compressor apparatus communicating with the connecting pipe of the spray head device via the breather pipe.

Preferably, the breathing line comprises a main ventilation pipe, a distributor, and a branch breather pipe. One end of the main ventilation pipe is connected to the air compressor apparatus, the other end of the main ventilation pipe is in communication with a plurality of the branch breather pipes via the distributor, and the tail end of the branch breather pipe is in communication with the injection pipe of the spray head device.

Preferably, the sandblasting device for automobile part processing further includes a jig for holding the automobile part, multiple jigs are provided, and multiple jigs are respectively provided toward the spray head device.

Preferably, the sandblasting device for automobile part processing further includes a box body. The upper end of the box body has a top cover, the sand cylinder is mounted on the upper end of the top cover, the main pipe penetrates through the top cover and is used for extending to the inside of the box body, and multiple jigs are arranged inside the box body and are respectively arranged toward the spray head device.

DESCRIPTION OF REFERENCE NUMERALS

Figure 1:
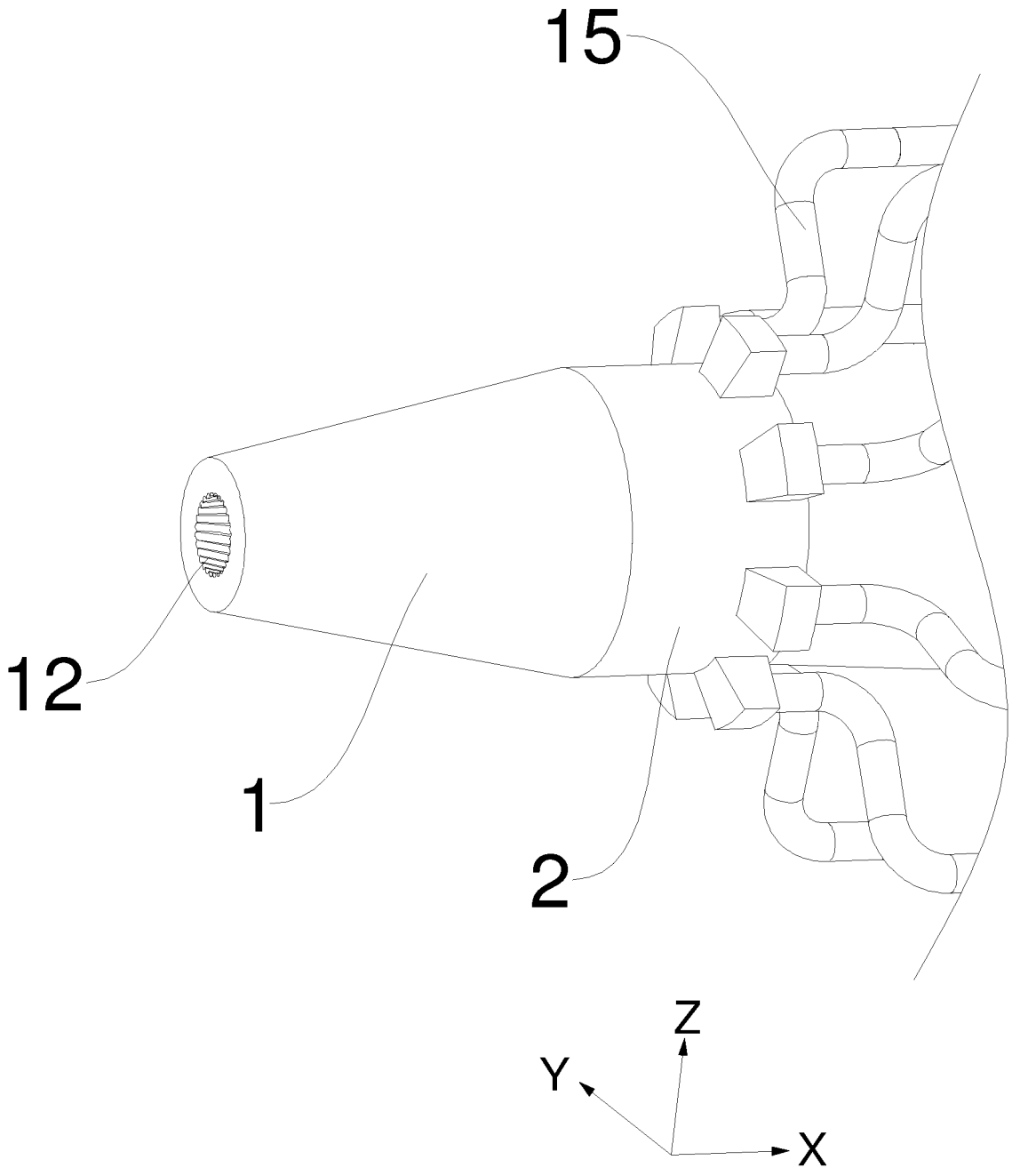
FIG. 1 is a schematic view illustrating a structure of a spray head device according to the present disclosure.

1 spray head body, 11 conical through hole, 12 discharge port, 13 feed port, 14 spiral trunking, 15 spraying pipe, 16 mounting block, 17 connecting hole, 2 connecting pipe, 3 sand cylinder, 4 feeding pipeline, 41 main pipe, 42 branch pipe, 43 branch joint, 44 main material port, 45 branch material port, 5 microtexture, 6 air compressor apparatus, 7 feeding pipeline, 71 main breather pipe, 72 distributor, 73 branch breather pipe, 8 jig, 9 box body, and 90 top cover.

DETAILED DESCRIPTION OF THE DISCLOSURE

The implementation mode of the present application is described in further detail below with reference to the accompanying drawings and embodiments. The following embodiments are illustrative of the present application but are not intended to limit the scope thereof.

In the description of the present disclosure, it is to be understood that the orientation or positional relationships indicated by the terms "up", "down", "front", "rear", "left", "right", etc. are based on the orientation or positional relationship shown in the drawings, and are only for the convenience of describing the disclosure and simplifying the description, rather than indicating or implying that the referred device or element must have a specific orientation, or be constructed and operated in a specific orientation, and therefore cannot be construed as a limitation of the present disclosure.

It needs to be noted that in the coordinate system XYZ provided herein, the forward direction of the X axis represents right, the reverse direction of the X axis represents left, the forward direction of the Y axis represents front, the reverse direction of the Y axis represents rear, the forward direction of the Z axis represents above, and the reverse direction of the Z axis represents below; the Z-axis, X-axis, and Y-axis are meant only to facilitate the description of the present disclosure and to simplify the description, and do not indicate or imply that the device or element being referred to must have a particular orientation or be constructed and operated in a particular orientation, and therefore should not be construed as limiting the disclosure.

Figure 2:
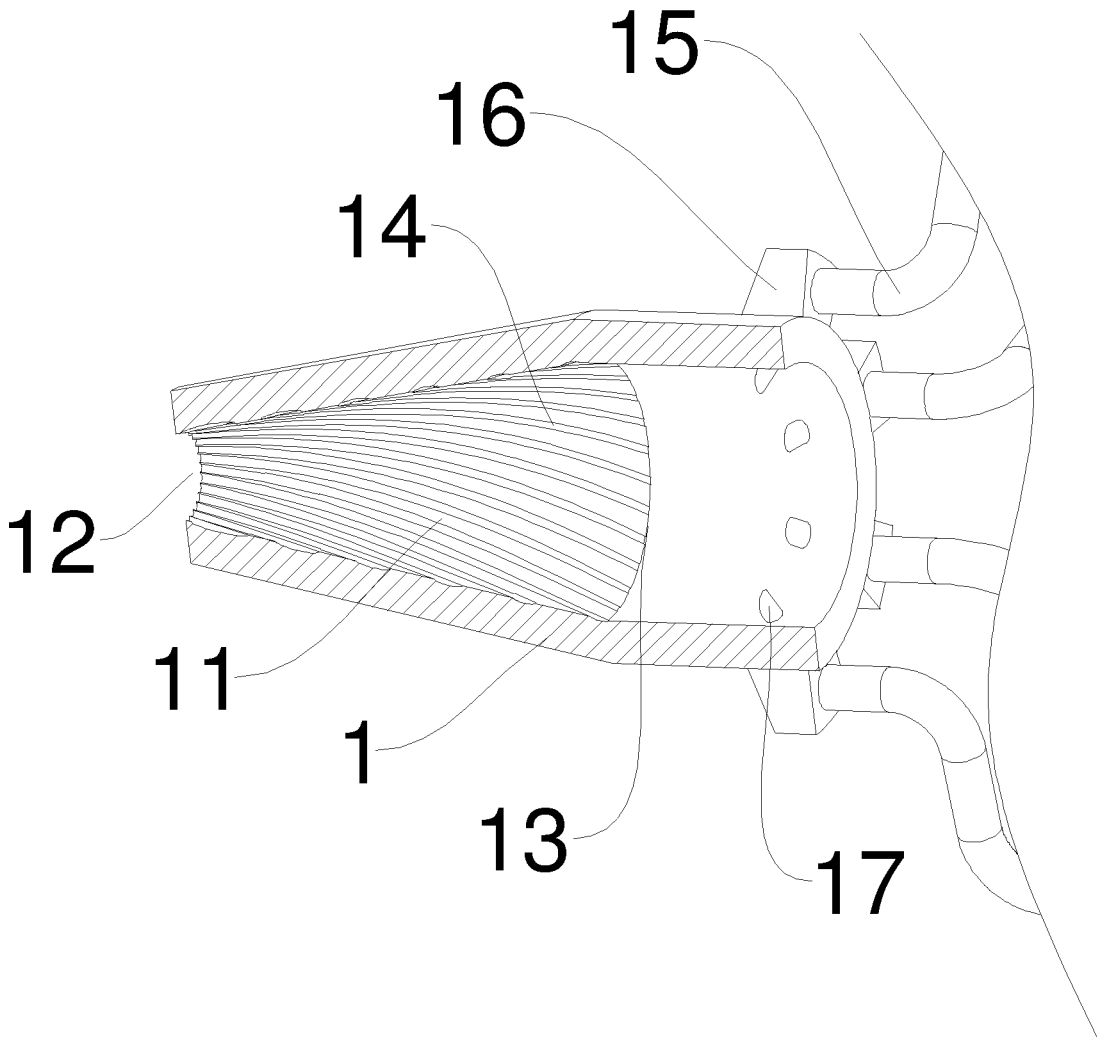
FIG. 2 is a schematic cross-sectional structural view showing a spray head device according to the present disclosure.

With reference to FIGS. 1 and 2, the present disclosure provides a spray head device, comprising a sprinkler body 1 and a connecting pipe 2. A conical through hole 11 is penetratingly arranged in the sprinkler body 1, one end of the conical through hole 11 forms a discharge port 12, and the other end of the conical through hole 11 forms a feed port 13; the caliber of the feed port 13 is greater than the caliber of the discharge port 12, the connecting pipe 2 is fixedly connected to the feed port 13 of the sprinkler body 1, the connecting pipe 2 is coaxially arranged with the conical through hole 11, and the caliber of the connecting pipe 2 is adapted to the caliber of the feed port 13;

with reference to FIGS. 1 and 2, the inner wall of the conical through hole 11 is provided with a plurality of spiral trunkings 14 at intervals, the spiral trunkings 14 extend from one end of the feed port 13 to one end of the discharge port 12, and two ends of the spiral trunkings 14 are provided to be through the spray head body 1;

the side wall of the connecting pipe 2 is provided with a plurality of injection pipes 15 at regular intervals in its circumferential direction, the injection pipes 15 communicating with the connecting pipe 2.

In the present embodiment, the conical through hole 11 is penetratingly provided in the spray head body 1, and the spraying material enters the conical through hole 11 from the feeding port 13 via the connecting pipe 2, and is then ejected from the discharging port 12; since the caliber of the conical through hole 11 becomes gradually smaller, the spraying material will accelerate, and the dispersion of the ejected spraying material can be reduced; the arrangement of the spiral trunking 14 enables the ejected spraying material to rotate around the spiral trunking 14, so as to increase the ejecting speed of the spraying material, improve the impact force, and enhance the exploitative effect; two ends of the spiral trunking 14 are arranged to be through the spray head body 1, so as to facilitate spraying material being ejected out to the automobile parts through the spiral trunking 14; multiple injection pipes 15 are evenly spaced on the side wall of the connecting pipe 2, and this structure enables the airflow to flow into the conical through hole 11 to be evenly distributed, thereby facilitating the spraying material ejected by the airflow more uniform, so as to improve the spraying effect.

Specifically, the taper of the conical through hole 11 is in the range of 0.16-0.3.

Preferably, the spiral trunking 14 extends in the form of a conical helix.

Specifically, the distance between two adjacent spiral trunkings 14 ranges from 10 mm to 15 mm, the number of turns ranges from 0.5 turns to 1 turn, and the conical helix is a right-hand helix.

In this embodiment, the right spiral line causes the ejected liquid to rotate around the spiral line, and the ejected liquid converges into a straight line, further reducing the dispersion of the spraying material; the spraying material is more concentrated, enhancing the sandblasting effect.

Preferably, the side wall of the connecting pipe 2 is provided with a plurality of mounting blocks 16 at uniform intervals along its circumferential direction, a communication hole 17 is provided through the mounting block 16, one end of the communication hole 17 penetrates through the side wall of the connecting pipe 2 to communicate with the connecting pipe 2, and the mounting block 16 communicates with the injection pipe 15 via the communication hole 17;

one end of the injection pipe 15 away from the connecting pipe 2 is used for being connected to the air compressor apparatus 6.

In the present embodiment, the injection pipe 15 is connected to the air compressor apparatus 6, the spraying material flows into the conical through hole 11, and the airflow output by the air compressor apparatus 6 is controlled to enter the conical through hole 11 via the injection pipe 15 to form a spiral high-speed injection beam. The high-speed injection beam injects the spraying material at a high speed onto the surface of the automobile parts to be treated, and the compressed air and the spraying material are directly injected onto the surface of the automobile parts in a swirling manner, with a wide range of sandblasting, high efficiency, and good effect, which is beneficial to improving the spraying quality of the automobile parts; multiple injection pipes 15 are evenly spaced on the side wall of the connecting pipe 2, and this structure enables the airflow to flow into the conical through hole 11 to be uniformly distributed, thereby facilitating the spraying material ejected by the airflow more uniform, so as to improve the spraying effect.

Figure 3:
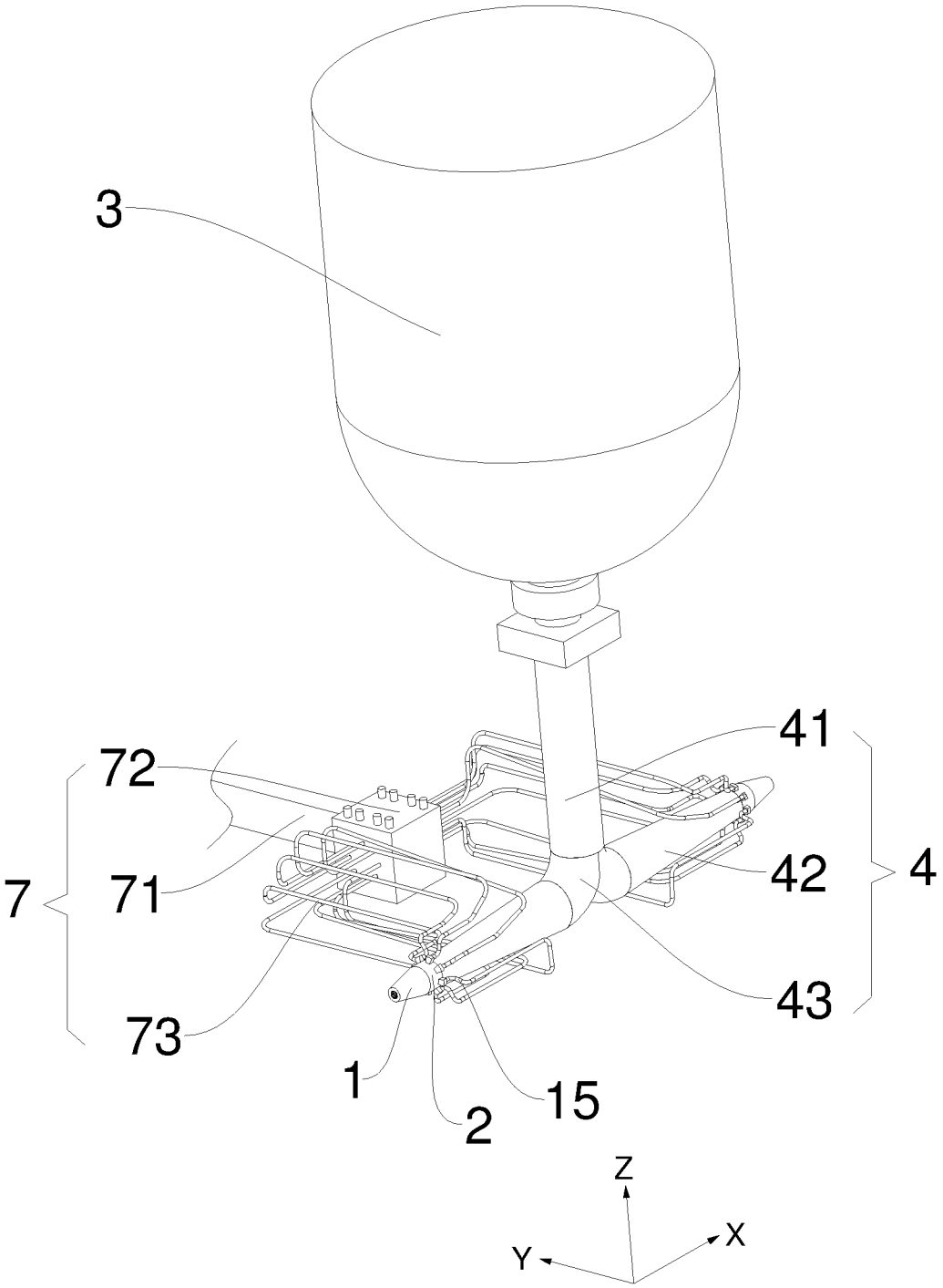
FIG. 3 is a schematic view of a feeding pipeline and a feeding pipeline structure according to the present disclosure.
Figure 4:
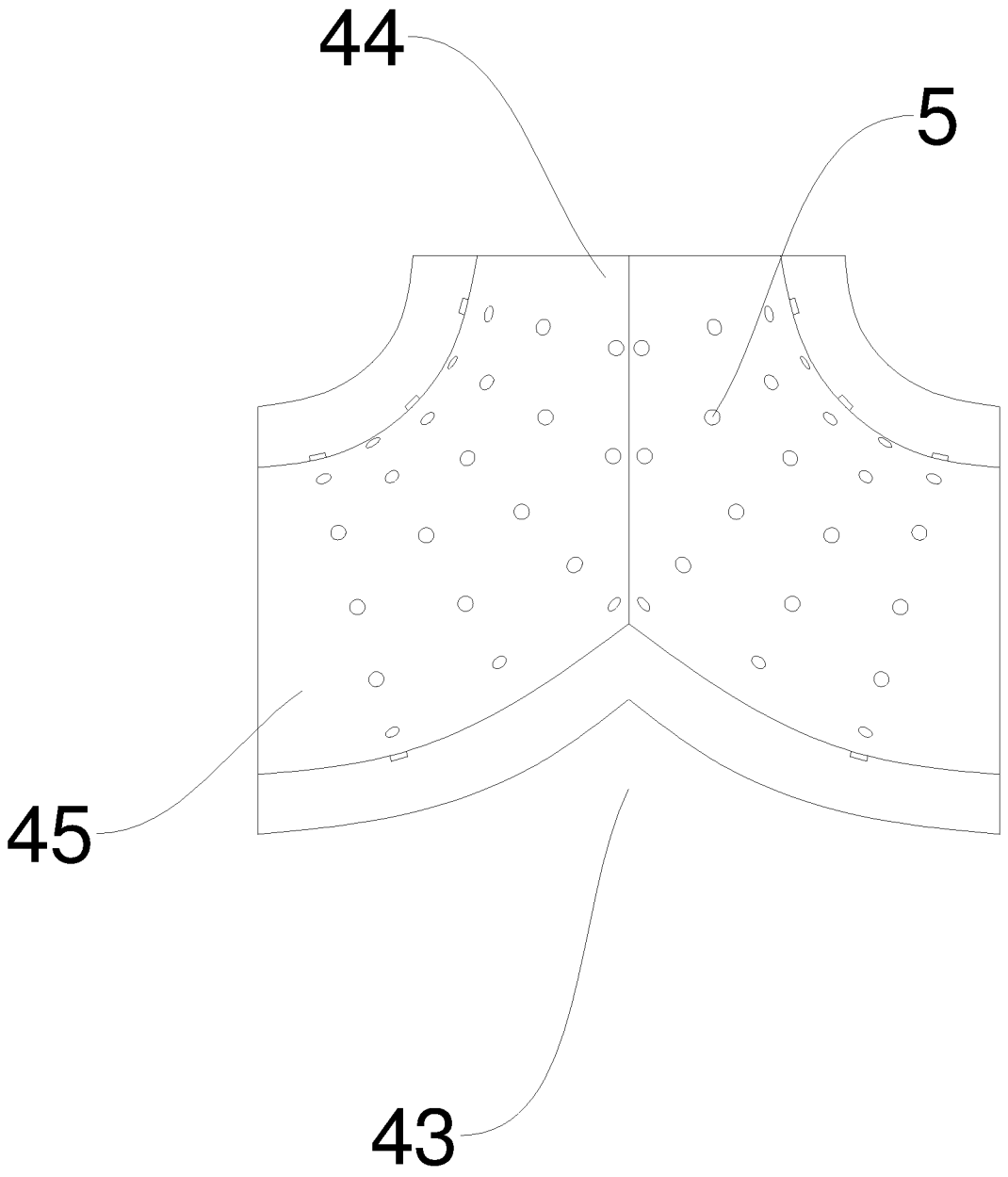
FIG. 4 is a schematic view of an inner surface of a branch joint according to the present disclosure.
Figure 5:
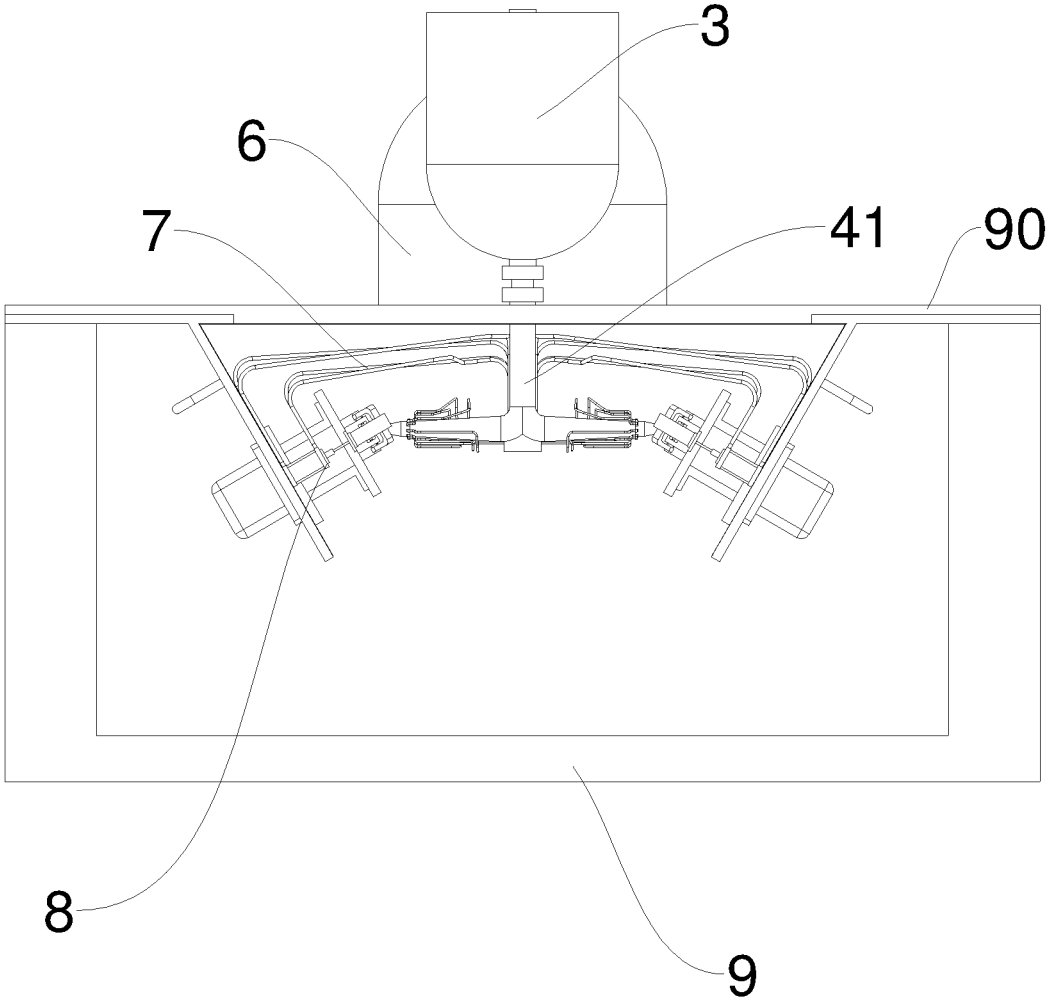
FIG. 5 is a schematic view showing an overall structure of the present disclosure.

Referring to FIGS. 3-5, the present disclosure also provides a sandblasting device for automobile part processing, comprising the spray head device as described above.

With the sandblasting device for automobile part processing of the present embodiment, the spraying material enters the conical through hole 11 from the feeding port 13 via the connecting pipe 2, and then is ejected from the discharging port 12; since the caliber of the conical through hole 11 becomes gradually smaller, the spraying material will accelerate, and the dispersion of the ejected spraying material can be reduced; the arrangement of the spiral trunking 14 enables the ejected spraying material to rotate around the spiral trunking 14, so that the ejecting speed of the spraying material becomes greater, the impact force is improved, and the exploitive effect is enhanced; the injection pipe 15 is connected to the air compressor apparatus 6, the spraying material flows into the conical through hole 11, and the air flow output by the air compressor apparatus 6 is controlled to enter the conical through hole 11 via the injection pipe 15 to form a spiral high-speed injection beam; the high-speed injection beam injects the spraying material at a high speed onto the surface of the automobile parts to be treated, and the compressed air and the spraying material are directly injected onto the surface of the automobile parts in a swirling manner, with a wide range of sandblasting, high efficiency, and good effect, which is beneficial to improving the quality of automobile part sandblasting.

With reference to FIGS. 3-4, preferably, the sandblasting device for automobile part processing further comprises a sand cylinder 3 and a feeding pipeline 4. One end of the feeding pipeline 4 is connected to the sand cylinder 3, and the other end of the feeding pipeline 4 is connected to the connecting pipe 2 of the spray head device, and the inner wall of the feeding pipeline 4 is provided with microtextures 5 at intervals.

Specifically, the microtexture 5 means that a pattern having a certain size, geometry, and arrangement is prepared on the surface of the friction pair by using a specific micro-machining process to improve the tribological properties of the surface.

The areal density of the microtextures 5 ranges from 20% to 60%, the size of an individual texture of the microtextures 5 is on the order of micrometers, and the spacing between two adjacent individual textures of the surface dimple textures is on the order of micrometers or millimeters.

In this embodiment, the special structure of the microtextures 5 ensures superior surface friction properties such that the friction surface has a low coefficient of friction, low frictional force, and low material wear.

The microtexture 5 in the present disclosure comprises a dimple texture, the individual texture in the microtexture 5 is a point-like microtexture 5, and the structure thereof is a pit or a groove. The shape of the individual texture in the microtexture 5 is preferably a circle, or the shape of the individual texture in the microtexture 5 can also be various shapes of an ellipse, a triangle, a rectangle, or a combination thereof.

In other implementation modes, the microtexture 5 of the present disclosure may also be a linear microtexture 5 or a reticulated microtexture 5, or other surface treatments, such as fish scale barb, can also be used.

In the present embodiment, the feeding pipeline 4 is used for connecting the spray head device and the sand cylinder 3, and the microtexture 5 provided on the inner wall of the feeding pipeline 4 is beneficial to reducing the friction coefficient and reduce the pressure loss and speed loss of the spraying material.

With reference to FIGS. 3 and 4, preferably, the feeding pipeline 4 comprises a main pipeline 41, a branch pipe 42, and a branch joint 43. One end of the main pipeline 41 is in communication with a plurality of the branch pipes 42 via the branch joint 43, and the spray head device is provided at the tail end of the branch pipes 42;

the microtexture 5 is arranged on the inner wall of the branch joint 43.

Specifically, one end of the shunting joint 43 has a main material port 44, the other end of the shunting joint 43 has a plurality of branch material ports 45, the caliber of the branch material ports 45 is smaller than the caliber of the main material port 44, the caliber of the main pipe 41 is consistent with the caliber of the main material port 44, and the caliber of the branch pipe 42 is consistent with the caliber of the branch material ports 45; at least two distribution ports 45 are provided, and two distribution ports 45 are provided in the branch joint 43 in the present disclosure, and two branch pipes 42 are correspondingly provided.

In the present embodiment, the main pipe 41 is divided into a plurality of branch pipes 42 via the branch joint 43, so as to facilitate the simultaneous operation of a plurality of spray heads to perform sandblasting on a plurality of automobile parts, which is beneficial to improving the efficiency of sandblasting; moreover, the caliber of the branch pipe 42 is smaller than the caliber of the main pipe 41, so as to improve the sandblasting speed and thus improve the sandblasting efficiency; the microtexture 5 is arranged on the inner wall of the branch joint 43, which is beneficial to reducing the friction coefficient and reducing the pressure loss and the speed loss of the spraying material, and is also beneficial to avoiding increasing the cost by arranging the microtexture 5 in a large area.

Referring to FIG. 3, preferably, the sandblasting device for automobile part processing further comprises an air compressor apparatus 6 and a breather pipe 7, the air compressor apparatus 6 communicating with the connecting pipe 2 of the spray head device via the breather pipe 7.

In the present embodiment, the breathing line 7 is used to connect the spray head device and the air compressor apparatus 6; the spraying material flows into the conical through hole 11, and the air flow output by the air compressor apparatus 6 is controlled to enter the injection pipe 15 via the ventilation pipeline 7, so that the air flow enters the conical through hole 11 to form a spiral high-speed injection beam, and the high-speed injection beam injects the spraying material at a high speed onto the surface of an automobile part to be treated.

Preferably, the ventilation line 7 comprises a main ventilation pipe 71, a distributor 72, and a branch breather pipe 73. One end of the main ventilation pipe 71 is connected to the air compressor apparatus 6, the other end of the main ventilation pipe 71 is in communication with a plurality of the branch breather pipes 73 via the distributor 72, and the tail end of the branch breather pipe 73 is in communication with the injection pipe 15 of the spray head device.

In the present embodiment, the distributor 72 is provided such that the air flow in the main breather pipe 71 is uniformly distributed into the branch breather pipe 73. The branch breather pipe 73 is connected to the injection pipe 15, so that the air flow entering the inside of the conical through hole 11 is uniformly introduced from the periphery. Therefore, the sandblasting is uniform, thereby improving the sandblasting effect.

Referring to FIG. 5, it is preferable that the sandblasting device for automobile part processing further includes a jig 8 for holding the automobile part, multiple jigs 8 are provided, and multiple jigs 8 are respectively provided toward the spray head device.

In the present embodiment, at least two jigs 8 are provided such that the work efficiency is greatly improved by simultaneously sandblasting the automobile parts on two or more jigs 8 by one sandblasting device for automobile part processing.

Referring to FIG. 5, it is preferable that the sandblasting device for automobile part processing further comprises a box body 9 having a top cover 90 at the upper end of the box body 9. The sand cylinder 3 is mounted at the upper end of the top cover 90, the main pipe 41 extends through the top cover 90 and to the inside of the box body 9, and multiple jigs 8 are provided inside the box body 9 and are respectively provided toward the shower head structure.

In the present embodiment, the sand cylinder 3 is mounted at the upper end of the top cover 90, and the main pipe 41 extends through the top cover 90 and is used to extend to the inside of the box body 9. The box body 9 provides an installation space for the sandblasting device for automobile part processing, and prevents the sandblasting device for automobile part processing from being operated in an open place to contaminate the entire large working environment.

Although the present disclosure is disclosed above, the scope of the present disclosure is not limited thereto. Various changes and modifications may be effected by one skilled in the art without departing from the spirit and scope of the disclosure, and it is intended that such changes and modifications fall within the scope of the present disclosure.

The invention claimed is:

1. A sandblasting device for automobile part processing, comprising:

a sand cylinder (3), a feeding pipeline (4), and a spray head device comprising:

a spray head body (1) and a connecting pipe (2), wherein a conical through hole (11) is penetratingly arranged in the spray head body (1), one end of the conical through hole (11) forms a discharge port (12), and the other end of the conical through hole (11) forms a feed port (13); a caliber of the feed port (13) is greater than that of the discharge port (12), the connecting pipe (2) is fixedly connected to the feed port (13) of the spray head body (1), the connecting pipe (2) is arranged coaxially with the conical through hole (11), and the caliber of the connecting pipe (2) is adapted to that of the feeding port (13);

multiple spiral trunkings (14) are arranged at intervals on an inner wall of the conical through hole (11), the spiral trunkings (14) extend from one end of the feeding port (13) to one end of the discharging port (12), and two ends of the spiral trunkings (14) are arranged to be through the spray head body (1); and multiple injection pipes (15) are evenly spaced along a circumferential direction of a side wall of the connecting pipe (2), and the injection pipes (15) communicate with the connecting pipe (2);

wherein one end of the feeding pipeline (4) is connected to the sand cylinder (3), and the other end of the feeding pipeline (4) is connected to the connecting pipe (2) of the spray head device, and microtextures (5) are provided at intervals on the inner wall of the feeding pipeline (4).

2. The sandblasting device for automobile part processing according to claim 1, wherein the feeding pipeline (4) comprises a main pipe (41), a branch pipe (42), and a branch joint (43), one end of the main pipe (41) being in communication with a plurality of the branch pipes (42) via the branch joint (43), and the spray head device being provided at a tail end of the branch pipe (42); and the microtexture (5) is arranged on the inner wall of the branch joint (43).

3. The sandblasting device for automobile part processing according to claim 2, further comprising a jig (8) for holding an automobile part, wherein the jig comprises multiple jigs (8), and each of the multiple jigs (8) are respectively provided toward the spray head device.

4. The sandblasting device for automobile part processing according to claim 3, further comprising a box body (9) having a top cover (90) at an upper end of the box body (9), wherein the sand cylinder (3) is mounted to the upper end of the top cover (90), the main pipe (41) penetrates through the top cover (90) and is used to extend to an interior of the box body (9), and multiple jigs (8) are provided inside the box body (9) and are respectively provided toward the spray head device.

5. The sandblasting device for automobile part processing according to claim 1, further comprising an air compressor apparatus (6) and a breathing line (7), wherein the air compressor apparatus (6) communicates with the connecting pipe (2) of the spray head device via the breathing line (7).

6. The sandblasting device for automobile part processing according to claim 5, wherein the breathing line (7) comprises a main breather pipe (71), a distributor (72), and a branch breather pipe (73), one end of the main breather pipe (71) being connected to the air compressor apparatus (6), the other end of the main breather pipe (71) being in communication with a plurality of the branch breather pipes (73) via the distributor (72), and the tail end of the branch breather pipe (73) being in communication with the injection pipe (15) of the spray head device.

7. The sandblasting device of claim 1, wherein the spiral trunking (14) extends in the form of a conical helix.

8. The sandblasting device of claim 1, wherein the side wall of the pipe (2) is provided with the plurality of mounting blocks (16) at even intervals along its circumferential direction, a communication hole (17) is penetratingly provided in each of the mounting blocks (16), one end of each communication hole (17) penetrates through the side wall of the connecting pipe (2) to communicate with the connecting pipe (2), and the mounting block (16) communicates with its respective injection pipe (15) through its respective communication hole (17); and one end of each injection pipe (15) away from the connecting pipe (2) is used for connecting with the air compressor apparatus (6).

* * * * *